US011952177B2

(12) United States Patent
Omori et al.

(10) Patent No.: US 11,952,177 B2
(45) Date of Patent: Apr. 9, 2024

(54) SYNTHETIC RESIN CONTAINER CLOSURE

(71) Applicants: AptarGroup, Inc., Crystal Lake, IL (US); Nippon Closures Co., Ltd., Tokyo (JP)

(72) Inventors: Shinji Omori, Nagataro (JP); Takashi Sugiyama, Nagataro (JP); Timothy Michael Mazurkiewicz, Waukesha, WI (US); Pranav Bhatt, Mooresville, NC (US); Christopher Branca, Charlotte, NC (US)

(73) Assignees: Nippon Closures Co., Ltd., Tokyo (JP); AptarGroup, Inc., Crystal Lake, IL (US)

( * ) Notice: Subject to any disclaimer, the term of this patent is extended or adjusted under 35 U.S.C. 154(b) by 75 days.

(21) Appl. No.: 17/790,201

(22) PCT Filed: Jan. 7, 2021

(86) PCT No.: PCT/JP2021/000323
§ 371 (c)(1),
(2) Date: Jun. 30, 2022

(87) PCT Pub. No.: WO2021/141079
PCT Pub. Date: Jul. 15, 2021

(65) Prior Publication Data

US 2023/0034260 A1 Feb. 2, 2023

(30) Foreign Application Priority Data

Jan. 7, 2020 (JP) ..... 2020-000813
Jan. 7, 2020 (JP) ..... 2020-000814

(51) Int. Cl.
*B65D 41/34* (2006.01)
*B65D 41/32* (2006.01)
*B65D 55/16* (2006.01)

(52) U.S. Cl.
CPC ..... *B65D 41/3428* (2013.01); *B65D 41/325* (2013.01); *B65D 55/16* (2013.01)

(58) Field of Classification Search
CPC .... B65D 1/023; B65D 1/0246; B65D 1/0238; B65D 41/04; B65D 41/3428; B65D 41/3423; B65D 41/3409
(Continued)

(56) References Cited

U.S. PATENT DOCUMENTS 8,469,213 B2 * 6/2013 Ishii ..... B65D 55/16 220/837
2010/0032402 A1 2/2010 Widmer et al.
(Continued)

FOREIGN PATENT DOCUMENTS

EP 3321207 A1 5/2018
JP 2010018290 A 1/2010
(Continued)

OTHER PUBLICATIONS

Search Report dated Mar. 9, 2021 for PCT/JP2021/000323 of which this is subject application a US National Phase.

*Primary Examiner* — Robert J Hicks
(74) *Attorney, Agent, or Firm* — Wood, Phillips, Katz, Clark & Mortimer

(57) ABSTRACT

A closure includes: a body having a skirt wall in which an internal thread is formed; and a cylindrical tamper evident bottom portion which is connected to the skirt wall via a plurality of breakable bridge portions, and in which an engaging pieces to be engaged with an engaging jaw portion is disposed on an inner peripheral surface of the tamper evident bottom portion. A protruding piece protruding downward is disposed on the skirt wall of the body. An unbroken connecting piece is disposed to connect the skirt wall of the body and the tamper evident bottom portion and to allow the body to be moved upward with respect to the
(Continued)

tamper evident bottom portion. An extending portion is formed at an engaging piece serving as the engaging pieces at least in an angle region where the protruding piece is present.

16 Claims, 6 Drawing Sheets

(58) Field of Classification Search
USPC ..... 220/375, 837, 836; 215/306, 243, 237, 215/44, 43, 329, 316, 253, 252, 250
See application file for complete search history.

(56) References Cited

U.S. PATENT DOCUMENTS

| | | | | |
|---|---|---|---|---|
| 2018/0312305 | A1 | 11/2018 | Rognard | |
| 2020/0017260 | A1* | 1/2020 | Migas | B65D 55/16 |
| 2020/0399036 | A1* | 12/2020 | Dai | B65D 41/325 |
| 2021/0371168 | A1* | 12/2021 | Graux | B65D 41/3428 |
| 2022/0081171 | A1* | 3/2022 | Erwin | B65D 41/3428 |

FOREIGN PATENT DOCUMENTS

| | | | |
|---|---|---|---|
| JP | 2014061929 | A | 4/2014 |
| TW | 201144172 | A1 | 12/2011 |

* cited by examiner

[FIG. 1]
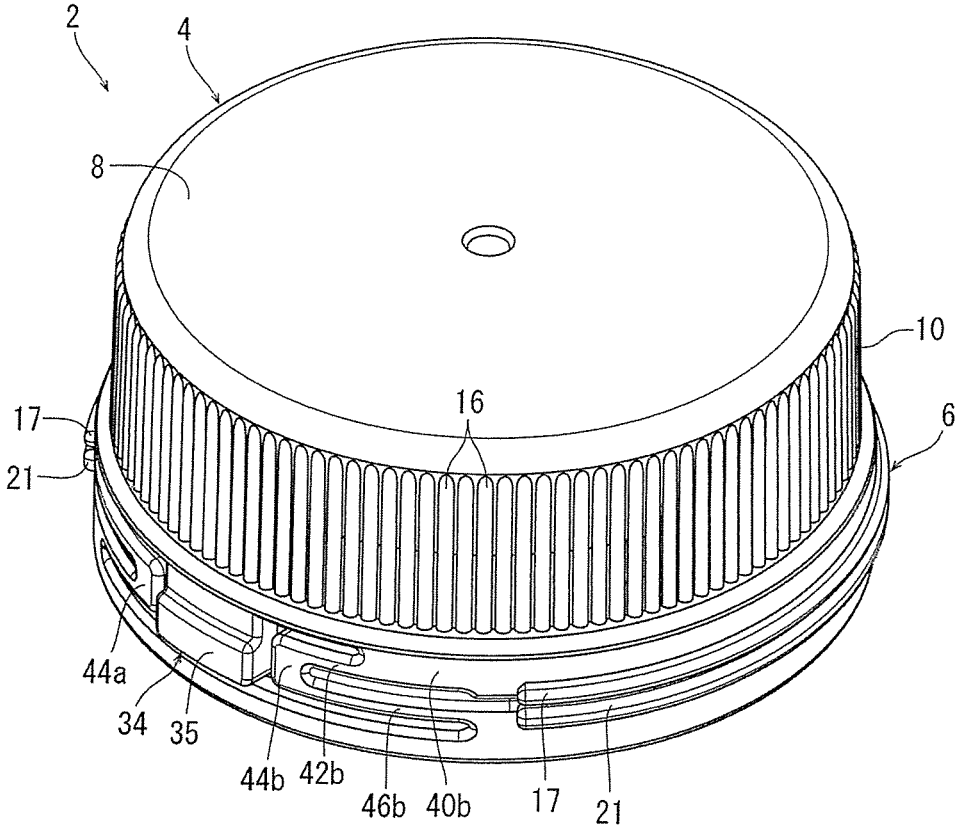

[FIG. 2]
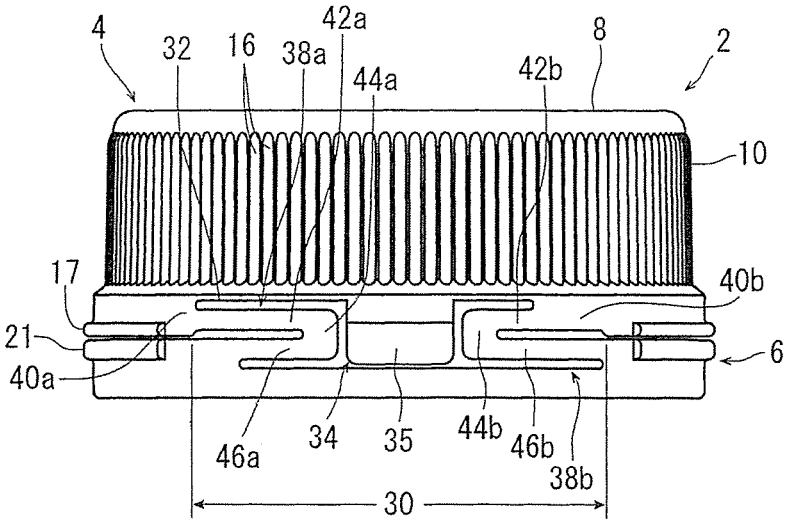
[FIG. 3]
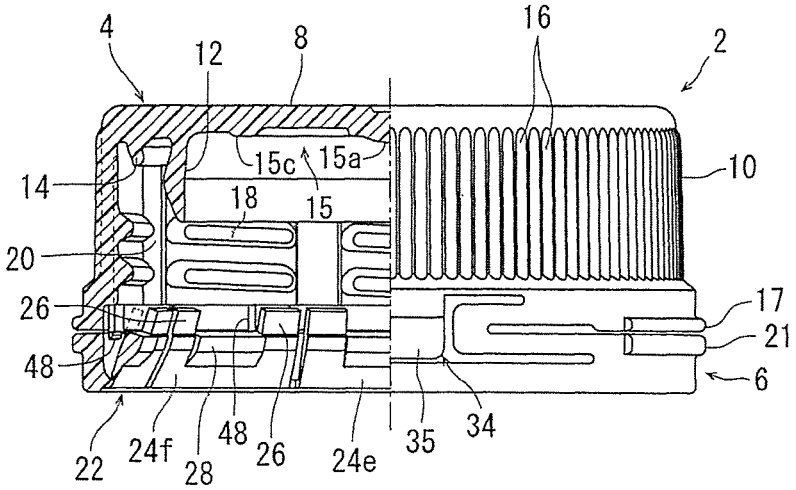

[FIG. 4]
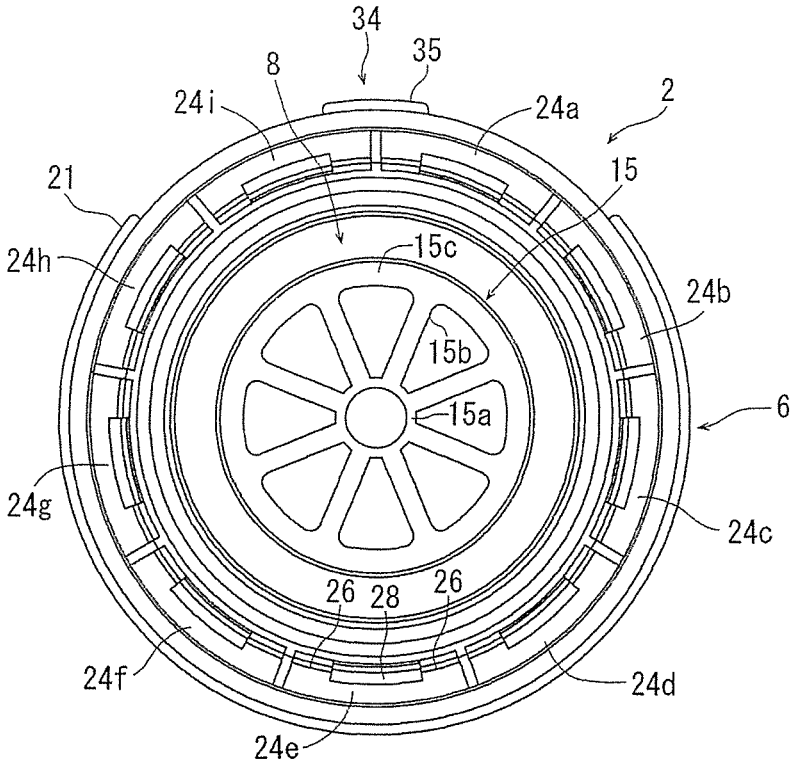
[FIG. 5]
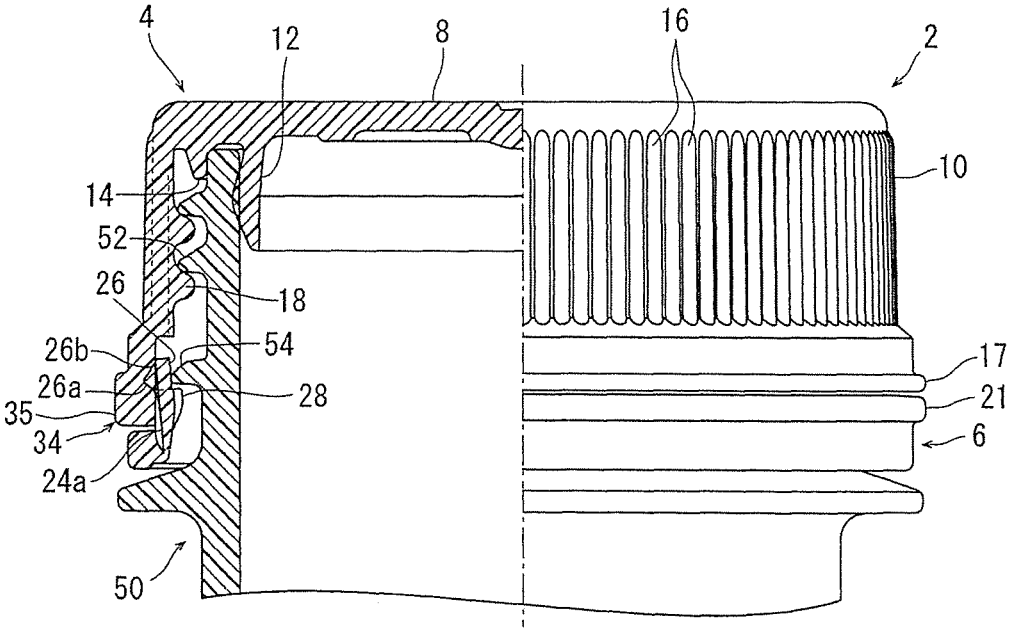

[FIG. 6]
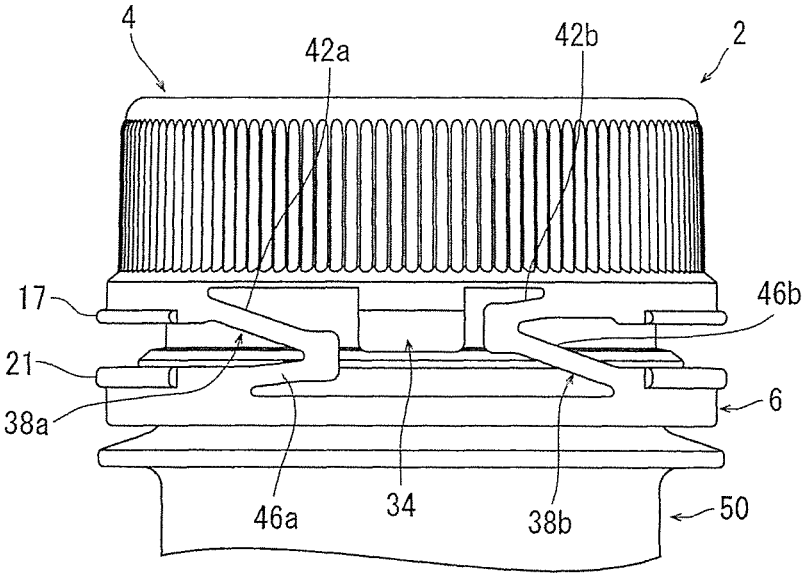
[FIG. 7]
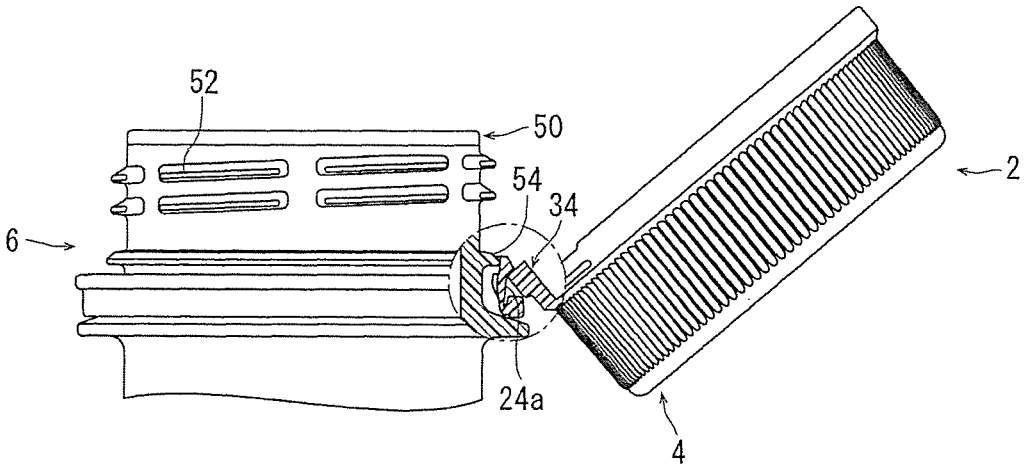

[FIG. 8]
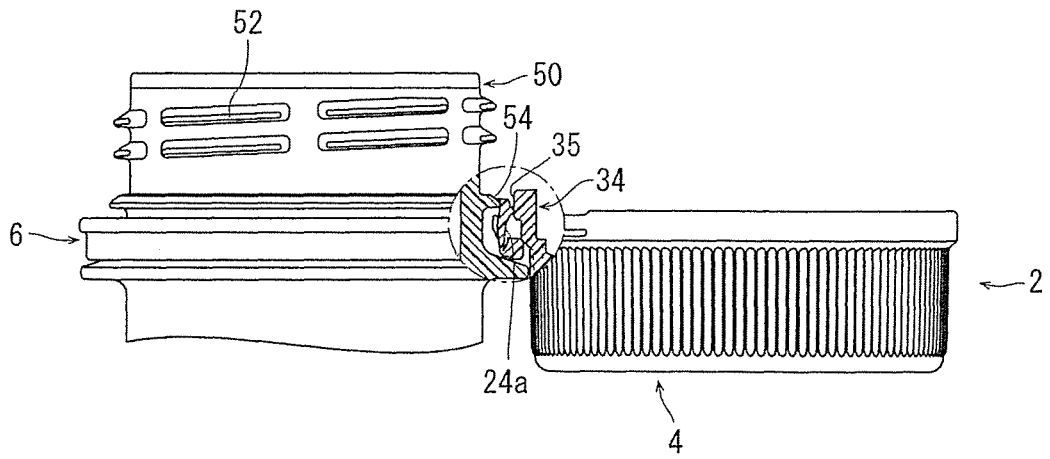
[FIG. 9]
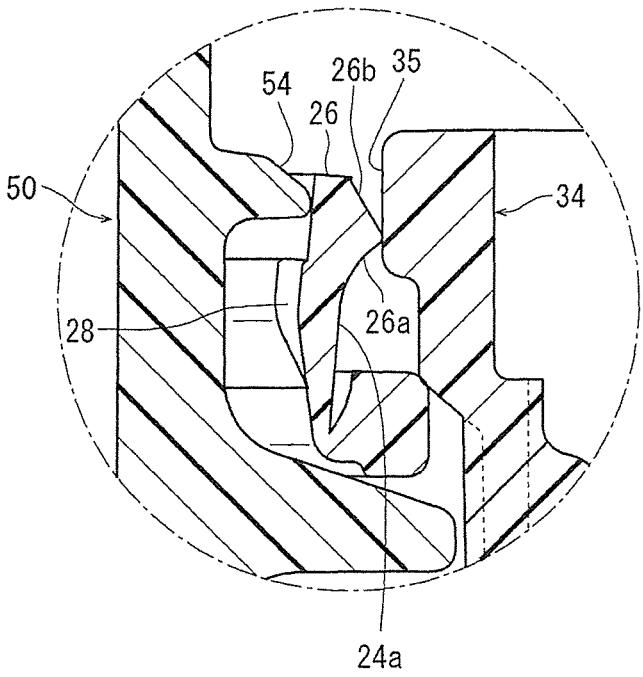

[FIG. 10]
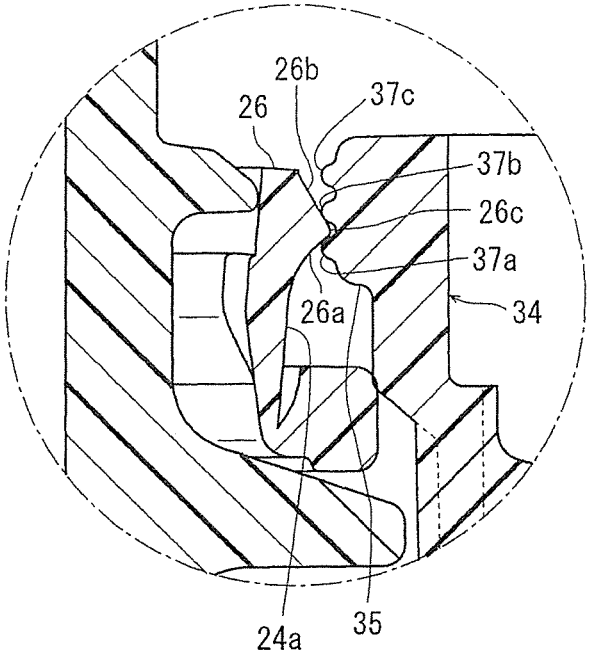

SYNTHETIC RESIN CONTAINER CLOSURE

FIELD OF THE INVENTION

The present invention relates to a synthetic resin container closure with tamper evident properties that is applied to a container in which an external thread and an engaging jaw portion located below the external thread are formed on the outer peripheral surface of a mouth-and-neck portion, and is not separated, as a whole, from the mouth-and-neck portion of the container even after the mouth-and-neck portion of the container is unsealed.

BACKGROUND OF THE INVENTION

Patent Documents 1 to 3 below disclose a synthetic resin container closure to be applied to a container in which an external thread and an engaging jaw portion located below the external thread are formed on the outer peripheral surface of a mouth-and-neck portion. The synthetic resin container closure includes: a body which has a top panel wall, and a cylindrical skirt wall extending downwardly from the peripheral edge of the top panel wall, and in which an internal thread to be screwed to the external thread of the mouth-and-neck portion is formed on the inner peripheral surface of the skirt wall; and a cylindrical tamper evident bottom portion which is connected to the skirt wall of the body via a plurality of breakable bridge portions arranged with spacing in a circumferential direction, and in which an engaging means to be engaged with the engaging jaw portion is disposed on the inner peripheral surface of the cylindrical tamper evident bottom portion. The engaging means is composed of a plurality of engaging pieces arranged with spacing in the circumferential direction, each of the engaging pieces extending upward and radially inwardly from a base end connected to the tamper evident bottom portion, or a single engaging piece extending continuously in the circumferential direction and extending upward and radially inwardly from the base end connected to the tamper evident bottom portion. A protruding piece protruding downward is disposed on the skirt wall of the body. On one side or both sides in the circumferential direction of the protruding piece, there is disposed an unbroken connecting piece which connects the skirt wall of the body and the tamper evident bottom portion and allows the body to be moved upward with respect to the tamper evident bottom portion.

In mounting the above-described container closure on the mouth-and-neck portion of the container to seal the mouth-and-neck portion, the container closure is fitted on the mouth-and-neck portion and rotated in a closing direction to screw the internal thread of the container closure to the external thread of the mouth-and-neck portion. As the screwing proceeds, the container closure is lowered down the mouth-and-neck portion, and the engaging means formed at the tamper evident bottom portion elastically passes over the engaging jaw portion of the mouth-and-neck portion until it is located below the engaging jaw portion. In unsealing the mouth-and-neck portion, the container closure is rotated in an opening direction to release the screwing between the external thread of the mouth-and-neck portion and the internal thread of the container closure. In response to the release of the screwing, the body of the container closure is allowed to ascend relative to the mouth-and-neck portion. On the other hand, the tamper evident bottom portion is inhibited from ascending because the engaging means is engaged with the engaging jaw portion of the mouth-and-neck portion. Accordingly, the breakable bridge portions are placed under stress and broken. After the breakable bridge portions are broken, the body continues to ascend and is spaced upward from the tamper evident bottom portion. This causes the unbroken connecting piece to be deformed, but it will not be broken, and the tamper evident bottom portion continues to be mounted on the mouth-and-neck portion. Thus, even after the body is removed from the mouth-and-neck portion, it continues to be connected to the tamper evident bottom portion via the unbroken connecting piece. Consequently, the body will never be separated from the mouth-and-neck portion of the container. After the body of the container closure is removed from the mouth-and-neck portion, it is pivoted away from the mouth-and-neck portion about a predetermined site of the unbroken connecting piece. When the body of the container closure has been pivoted by more than a predetermine angle, a front end part of the protruding piece formed on the skirt wall elastically passes over the engaging jaw portion of the mouth-and-neck portion until it is located on the upper surface side of the engaging jaw portion. As a result, the body is inhibited from heading back toward the mouth-and-neck portion and is held at a position spaced apart from the mouth-and-neck portion, so that the mouth-and-neck portion is kept unsealed. When the front end part of the protruding piece elastically passes over the engaging jaw portion, a sound is produced due to the protruding piece being elastically deformed and then elastically restored, allowing a consumer to realize that the body of the container closure has been pivoted to a required opening position.

PRIOR ART DOCUMENTS

Patent Documents

Patent Document 1: JP-A-2010-18290
Patent Document 2: JP-A-2012-76771
Patent Document 3: JP-A-2014-31202

BRIEF SUMMARY OF THE INVENTION

Problems to be Solved by the Invention

Recently, there has been a demand for light-weight packaging containers from the viewpoint of environmental issues and reduction in material cost. Meanwhile, container closures have also been required to be thinner and smaller in an axial direction. Under the circumstances, the present inventors have noticed from experience that the above-described conventional container closure has the following problems to be solved, especially in a case where the mouth-and-neck portion is relatively short in the axial direction, and accordingly the axial dimension of the container closure is relatively small (in other words, the container closure has a relatively small height in a vertical direction.) When the body removed from the mouth-and-neck portion is pivoted away from the mouth-and-neck portion for the purpose of unsealing the mouth-and-neck portion, the front end part of the protruding piece elastically passes over the engaging jaw portion of the mouth-and-neck portion until it is located above the engaging jaw portion. At this time, the protruding piece has a relatively short extending length because of the relatively small axial dimension of the container closure, whereby the mutual interference between the protruding piece and the engaging jaw portion is excessively small. This causes the following problems: (1) There is a tendency that the front end part of the protruding piece accidentally gets back to a position below the engaging jaw portion after once being located above the engaging jaw portion, so that the body may not be kept at a required opening position; and (2) a sound produced at the time the protruding piece elastically passes over the engaging jaw portion is unsatisfactory, so that a consumer is often unable to realize that the body has been pivoted to a required opening position.

In order to solve the above-described problems, the present inventors previously proposed, in the specification of Japanese Patent Application No. 2019-025644, to form an extending portion at the engaging piece at least in an angle region where the protruding piece is present. The extending portion is located between the engaging jaw portion of the mouth-and-neck portion and the tamper evident bottom portion in a state where the container closure is mounted on the mouth-and-neck portion. Thus, even if the container closure has a relatively short length in the axial direction, once the body removed from the mouth-and-neck portion is pivoted to a required opening position, it is kept at the required opening position with sufficient reliability, and a sound is produced sufficiently reliably such that it is audible to a consumer.

However, the synthetic resin container closure previously proposed by the present inventors is not fully satisfactory with the following problems still remaining. The body of the container closure is kept at a required opening position by the outer surface of a lower part of the protruding piece coming into contact with the outer surface of an upper part of the extending portion at the required opening position. In the case where the container closure is relatively short in the axial direction, the axial dimension of the protruding piece is also relatively small. Thus, the pivot angle of the body, when located at a required opening position, with respect to the mouth-and-neck portion of the container is not sufficiently large. As a result, when a user puts his/her mouth to an upper end part of the mouth-and-neck portion of the container, the lower end of the skirt wall comes into contact with user's face, which could make the user uncomfortable. Further, due to the relatively small axial dimension of the protruding piece, the outer surface of the lower part of the protruding piece is unable to come into contact with the outer surface of the upper part of the extending portion with sufficient reliability, so that the body of the container closure may not be kept at a required opening position.

The present invention has been accomplished in the light of the above-mentioned facts. Its principal technical challenge is to further improve the synthetic resin container closure previously proposed by the present inventors, thereby ensuring a sufficiently large pivot angle of the body, when located at a required opening position, with respect to the mouth-and-neck portion of the container, and keeping the body at the required opening position sufficiently reliably, even in the case where the container closure is relatively short in the axial direction.

Means for Solving the Problems

As a result of a further intensive study, the present inventors have found that the aforementioned principal technical challenge can be solved by forming a raised portion on the outer surface of the protruding piece. More specifically, when the body is rotated in an opening direction to unseal the mouth-and-neck portion sealed with the container closure mounted thereon, the breakable bridge portions are broken, so that the body is moved upward from the tamper evident bottom portion. When the body is pivoted about a predetermined site of the unbroken connecting piece by more than a predetermine angle with respect to the tamper evident bottom portion, the lower part of the protruding piece elastically passes over the extending portion until the raised portion of the protruding piece comes into contact with the outer surface of the extending portion.

Further, the present inventors, as a result of a further intensive study, have found that the aforementioned principal technical challenge can be solved by forming an interlock means on the outer surface of the extending portion, and an interlocking means to be interlocked with the interlock means on the outer surface of the protruding piece. More specifically, when the body is rotated in an opening direction to unseal the mouth-and-neck portion sealed with the container closure mounted thereon, the breakable bridge portions are broken, so that the body is moved upward from the tamper evident bottom portion. When the body is pivoted about a predetermined site of the unbroken connecting piece by more than a predetermine angle with respect to the tamper evident bottom portion, the lower part of the protruding piece elastically passes over the extending portion until the interlocking means of the protruding piece is interlocked with the interlock means of the extending portion.

According to a first aspect of the present invention, there is provided a synthetic resin container closure to be applied to a container in which an external thread and an engaging jaw portion located below the external thread are formed on an outer peripheral surface of a mouth-and-neck portion, the synthetic resin container closure including:

a body which has a top panel wall, and a cylindrical skirt wall extending downwardly from a peripheral edge of the top panel wall, and in which an internal thread to be screwed to the external thread is formed on an inner peripheral surface of the skirt wall; and a cylindrical tamper evident bottom portion which is connected to the skirt wall of the body via a plurality of breakable bridge portions arranged with spacing in a circumferential direction, and in which an engaging means to be engaged with the engaging jaw portion is disposed on an inner peripheral surface of the tamper evident bottom portion, the engaging means being composed of a plurality of engaging pieces disposed with spacing in the circumferential direction and extending upward and radially inwardly from a base end connected to the tamper evident bottom portion, or an annular engaging piece extending continuously in the circumferential direction and extending upward and radially inwardly from the base end connected to the tamper evident bottom portion, a protruding piece protruding downward being disposed on the skirt wall of the body, and an unbroken connecting piece being disposed to connect the skirt wall of the body and the tamper evident bottom portion and to allow the body to be moved upward with respect to the tamper evident bottom portion, wherein an extending portion is formed at the engaging piece at least in an angle region where the protruding piece is present, the extending portion being located between the engaging jaw portion of the mouth-and-neck portion and the tamper evident bottom portion in a state where the synthetic resin container closure is mounted on the mouth-and-neck portion, a raised portion is formed on an outer surface of the protruding piece, and when the body is rotated in an opening direction to unseal the mouth-and-neck portion sealed with the synthetic resin container closure mounted thereon, the breakable bridge portions are broken, so that the body is moved upward from the tamper evident bottom portion, and when the body is pivoted about a predetermined site of the unbroken connecting piece by more than a predetermine angle with respect to the tamper evident bottom portion, a lower part of the protruding piece elastically passes over the extending portion until the raised portion of the protruding piece comes into contact with an outer surface of the extending portion.

According to a second aspect of the present invention, there is provided a synthetic resin container closure to be applied to a container in which an external thread and an engaging jaw portion located below the external thread are formed on an outer peripheral surface of a mouth-and-neck portion, the synthetic resin container closure including:

a body which has a top panel wall, and a cylindrical skirt wall extending downwardly from a peripheral edge of the top panel wall, and in which an internal thread to be screwed to the external thread is formed on an inner peripheral surface of the skirt wall; and a cylindrical tamper evident bottom portion which is connected to the skirt wall of the body via a plurality of breakable bridge portions arranged with spacing in a circumferential direction, and in which an engaging means to be engaged with the engaging jaw portion is disposed on an inner peripheral surface of the tamper evident bottom portion, the engaging means being composed of a plurality of engaging pieces disposed with spacing in the circumferential direction and extending upward and radially inwardly from a base end connected to the tamper evident bottom portion, or an annular engaging piece extending continuously in the circumferential direction and extending upward and radially inwardly from the base end connected to the tamper evident bottom portion, a protruding piece protruding downward being disposed on the skirt wall of the body, and an unbroken connecting piece being disposed to connect the skirt wall of the body and the tamper evident bottom portion and to allow the body to be moved upward with respect to the tamper evident bottom portion, wherein an extending portion is formed at the engaging piece at least in an angle region where the protruding piece is present, the extending portion being located between the engaging jaw portion of the mouth-and-neck portion and the tamper evident bottom portion in a state where the synthetic resin container closure is mounted on the mouth-and-neck portion, and an interlock means is formed on an outer surface of the extending portion, an interlocking means to be interlocked with the interlock means is formed on an outer surface of the protruding piece, and when the body is rotated in an opening direction to unseal the mouth-and-neck portion sealed with the synthetic resin container closure mounted thereon, the breakable bridge portions are broken, so that the body is moved upward from the tamper evident bottom portion, and when the body is pivoted about a predetermined site of the unbroken connecting portion by more than a predetermine angle with respect to the tamper evident bottom portion, a lower part of the protruding piece elastically passes over the extending portion until the interlocking means of the protruding piece is interlocked with the interlock means of the extending portion.

Preferably, an engaging protrusion is formed on an inner surface of the engaging piece, the engaging protrusion protruding radially inwardly below the engaging jaw portion in a state where the synthetic resin container closure is mounted on the mouth-and-neck portion. It is favorable that the extending portion is also formed in a region other than the angle region where the protruding piece is present. It is suitable that the engaging means is composed of a plurality of the engaging pieces disposed with spacing in the circumferential direction and extending upward and radially inwardly from the base end connected to the tamper evident bottom portion, and the extending portion is formed in both side parts in the circumferential direction of each of the engaging pieces. It is preferred that the outer surface of the extending portion gradually protrudes radially outwardly in an upward direction and then gradually recedes radially inwardly in the upward direction, and that a site on the outer surface of the extending portion that gradually protrudes radially outwardly in the upward direction is concave arc-shaped in longitudinal cross section. It is desirable that arc-shaped projections extending continuously in the circumferential direction are formed in a lower end part of an outer peripheral surface of the skirt wall and an upper end part of an outer peripheral surface of the tamper evident bottom portion, respectively, except for a specific region, and an amount of radial protrusion of the raised portion corresponds to amounts of radial protrusion of the projections. It is suitable that an interlock means is formed on the outer surface of the extending portion, and an interlocking means to be interlocked with the interlock means is formed on the raised portion of the protruding piece. It is particularly suitable that the outer surface of the extending portion gradually protrudes radially outwardly in an upward direction and then gradually recedes radially inwardly in the upward direction; a boundary region between a site that gradually protrudes radially outwardly in the upward direction and a site that gradually recedes radially inwardly in the upward direction serves as the interlock means; and at least one projection or groove extending in the circumferential direction is formed on the raised portion of the protruding piece (or on an outer peripheral surface of the protruding piece when the raised portion is absent) to serve as the interlocking means.

Effects of the Invention

In the synthetic resin container closure according to the first aspect of the present invention, the raised portion formed on the outer surface of the protruding piece serves to hold the body at a required opening position by coming into contact with the outer surface of the extending portion. Thus, even if the container closure is relatively short in an axial direction, it is possible to ensure a large pivot angle of the body, when located at a required opening position, with respect to the mouth-and-neck portion of the container. Further, since the raised portion sufficiently reliably comes into contact with the outer surface of the extending portion, the body is sufficiently reliably kept at a required opening position.

In the synthetic resin container closure according to the second aspect of the present invention, the interlocking means formed on the outer surface of the protruding piece serves to hold the body at a required opening position by being interlocked with the interlock means formed on the outer surface of the extending portion. Thus, even if the container closure is relatively short in the axial direction, the body is sufficiently reliably kept at a required opening position. Further, it is possible to ensure a large pivot angle of the body, when located at a required opening position, with respect to the mouth-and-neck portion of the container.

BRIEF DESCRIPTION OF THE DRAWINGS

FIG. 1 is a perspective view showing a preferred embodiment of a container closure constituted in accordance with the present invention.

FIG. 2 is a front view of the container closure shown in FIG. 1.

FIG. 3 is a front view showing, partly in cross section, the container closure shown in FIG. 1.

FIG. 4 is a bottom view of the container closure shown in FIG. 1.

FIG. 5 is a right side view showing, partly in cross section, a state in which the container closure shown in FIG. 1 is mounted on a mouth-and-neck portion of a container.

FIG. 6 is a front view showing an intermediate state of an unsealing operation in which a body of the container closure in FIG. 1 has been rotated in an opening direction and ascended thereby to be removed from the mouth-and-neck portion of the container.

FIG. 7 is a side view showing, partly in cross section, a state in which the body of the container closure in FIG. 1 removed from the mouth-and-neck portion has been pivoted to some extent away from the mouth-and-neck portion.

FIG. 8 is a side view showing, partly in cross section, a state in which the body of the container closure in FIG. 1 removed from the mouth-and-neck portion of the container has been pivoted to a predetermined opening position away from the mouth-and-neck portion.

FIG. 9 is an enlarged view of the vicinity of a protruding piece in FIG. 8.

FIG. 10 is an enlarged view, similar to FIG. 9, showing another preferred embodiment of the container closure constituted in accordance with the present invention.

DETAILED DESCRIPTION OF THE PREFERRED EMBODIMENTS

Preferred embodiments of a synthetic resin container closure constituted in accordance with the present invention will now be described in further detail with reference to the accompanying drawings.

With reference to FIGS. 1 to 4 showing a preferred embodiment of the synthetic resin container closure constituted in accordance with the present invention, the container closure designated entirely as the numeral 2 can be advantageously integral-molded from a suitable synthetic resin, such as polyethylene or polypropylene, by injection molding or compression molding. The container closure 2 includes a body 4 and a tamper evident bottom portion 6. The body 4 has a circular top panel wall 8, and a cylindrical skirt wall 10 extending downwardly from the peripheral edge of the top panel wall 8. Two sealing projections, i.e., an inner annular projection 12 and an outer annular projection 14, are formed in an outer peripheral edge part of the inner surface of the top panel wall 8. A deformation preventing means 15 is provided in a central area of the inner surface of the top panel wall 8. The deformation preventing means 15 is composed of a protrusion 15*a* protruding downwardly in the center of the inner surface of the top panel wall 8, a plurality of ribs (eight ribs in the illustrated embodiment) 15*b* extending radially from the outer peripheral surface of the protrusion 15*a*, and a toric projection 15*c* the inner peripheral surface of which is connected with radially outer ends of the ribs 15*b*. The presence of the deformation preventing means 15 contributes to increasing the stiffness of the top panel wall 8. Thus, the top panel wall 8 is prevented from being deformed even if a positive pressure is present in a container by filling the container with a carbonated beverage, for example, and sealing a mouth-and-neck portion of the container with the container closure 2. In an intermediate part in a vertical direction of the outer peripheral surface of the skirt wall 10, irregularities 16 for preventing the slipperiness of fingers applied thereto are repeatedly formed. In a lower end part, except for a specific region to be described later, of the outer peripheral surface of the skirt wall 10, a projection 17 extending continuously in a circumferential direction along the lower edge of the skirt wall 10 is formed in the shape of an arc. The amount of radially outward protrusion of the projection 17 will be described later. An internal thread 18 is formed on the inner peripheral surface of the skirt wall 10. In the internal thread 18, notches 20 are formed to be spaced in the circumferential direction.

The tamper evident bottom portion 6 is cylindrical as a whole, and is connected to the skirt wall 10 of the body 4 via breakable bridge portions and a pair of unbroken connecting pieces to be described later. In an upper end part of the outer peripheral surface of the tamper evident bottom portion 6, a projection 21, corresponding to the projection 17 formed on the outer peripheral surface of the skirt wall 10, is formed continuously in the circumferential direction along the upper edge of the tamper evident bottom portion 6. The amount of radially outward protrusion of the projection 21 will be described later. An engaging means 22 is disposed on the inner peripheral surface of the tamper evident bottom portion 6. The engaging means 22 in the illustrated embodiment is composed of nine arc-shaped engaging pieces 24*a*-24*i* formed with spacing in the circumferential direction. Each of the arc-shaped engaging pieces 24*a*-24*i* extends axially upward and radially inwardly from a base end connected to the inner peripheral surface of the tamper evident bottom portion 6. Although the engaging means 22 in the illustrated embodiment is composed of the nine arc-shaped engaging pieces 24*a*-24*i* arranged with spacing in the circumferential direction, the engaging means 22 can be composed, if desired, of an annular engaging piece that extends continuously in the circumferential direction and extends axially upward and radially inwardly from the base end connected to the inner peripheral surface of the tamper evident bottom portion 6.

According to the container closure 2 constituted in accordance with the present invention, an extending portion 26 extending from a front end of each of the engaging pieces 24*a*-24*i* is formed at least in a region where a protruding piece 34 to be described later is formed. In the illustrated embodiment, two rectangular extending portions 26 are formed to extend respectively from both side parts in the circumferential direction of each of the engaging pieces 24*a*-24*i*. As will be clearly understood by reference to FIG. 9 along with FIGS. 3 and 4, it is preferable that the outer surface of each of the extending portions 26 gradually protrudes radially outwardly in an upward direction, and then gradually recedes radially inwardly in the upward direction. It is preferable that a site 26*a*, which gradually protrudes radially outwardly in the upward direction, is concave arc-shaped in longitudinal cross section. A site 26*b*, which gradually recedes radially inwardly in the upward direction, may have a conical trapezoidal shape. The inner surface of each of the extending portions 26 may be flat. It is desirable that an engaging protrusion 28 protruding radially inwardly is formed on the inner surface of a major part, i.e., a site other than the extending portions 26, of each of the engaging pieces 24*a*-24*i*. It is suitable that the engaging protrusion 28 gradually protrudes further in the upward direction, with its upper surface extending substantially horizontally. The engaging protrusion 28 is formed in a central part in the circumferential direction of each of the engaging pieces 24*a*-24*i*, namely, in an area where the extending portions 26 are not present. If desired, the engaging protrusion 28 can be formed over the entire length in the circumferential direction of each of the engaging pieces 24*a*-24*i*.

With further reference to FIGS. 2 to 4, in the specific region indicated by the numeral 30, the lower edge (connected with the protruding piece 34 to be described later) of the skirt wall 10 of the body 4 is displaced above the lower edge in the remaining region, while the upper edge (opposed to the lower edge of the protruding piece 34 to be described later) of the tamper evident bottom portion 6 is displaced below the upper edge in the remaining region. As a result, an opening 32 which is horizontally elongated in a front view is formed between the skirt wall 10 and the tamper evident bottom portion 6. In a central part in the circumferential direction of the opening 32, the nearly rectangular protruding piece 34 protruding downward from the lower end of the skirt wall 10 is formed in the skirt wall 10. As will be clearly understood by reference to FIG. 9 along with FIG. 2, the protruding piece 34 hangs down substantially vertically. It is important for the container closure 2 constituted in accordance with the present invention that a raised portion 35 is formed on the outer surface of the protruding piece 34. As will be understood by reference to FIGS. 1 and 5, the raised portion 35 is formed over the entire area in the circumferential direction of a lower half part of the outer surface of the protruding piece 34. If desired, the raised portion 35 may be formed over the entire area in the vertical direction of the outer surface of the protruding piece 34. The raised portion 35 is nearly rectangular in cross section, and the amount of its radial protrusion corresponds to the amounts of radial protrusion of the projection 17 and the projection 21 formed on the outer peripheral surfaces of the skirt wall 10 and the tamper evident bottom portion 6, respectively. In the illustrated embodiment, the amounts of radial protrusion of the raised portion 35, the projection 17, and the projection 21 are substantially the same. As a result, it is possible to prevent as much as possible some kind of member from being caught on both end surfaces in the circumferential direction of the raised portion 35 during the transfer of the container closure 2 by itself or with a container by being mounted on a mouth-and-neck portion thereof. Further, the upper end of the raised portion 35 and the upper end of the projection 17 when viewed in the vertical direction are located on substantially the same level.

As will be clearly illustrated in FIGS. 2 and 3, in the specific region 30, a pair of unbroken connecting pieces 38*a* and 38*b* are disposed adjacent to both sides in the circumferential direction of the protruding piece 34. The unbroken connecting piece 38*a* in the illustrated embodiment is composed of an upper end portion 40*a* connected to the lower edge of the skirt wall 10, a first tilting portion 42*a* extending substantially horizontally in succession to the upper end portion 40*a* to one side in the circumferential direction (to the right side in FIGS. 2 and 3), an intermediate portion 44*a*, and a second tilting portion 46*a* extending substantially horizontally below the first tilting portion 42*a* in succession to the intermediate portion 44*a* to the other side in the circumferential direction (to the left side in FIGS. 2 and 3) and connected to the tamper evident bottom portion 6. Similarly, the unbroken connecting piece 38*b* is composed of an upper end portion 40*b* connected to the lower edge of the skirt wall 10, a first tilting portion 42*b* extending substantially horizontally in succession to the upper end portion 40*b* to one side in the circumferential direction (to the left side in FIGS. 2 and 3), an intermediate portion 44*b*, and a second tilting portion 46*b* extending substantially horizontally below the first tilting portion 42*b* in succession to the intermediate portion 44*b* to the other side in the circumferential direction (to the right side in FIGS. 2 and 3) and connected to the tamper evident bottom portion 6. If desired, the first tilting portion 42*a* and the second tilting portion 46*a* in the unbroken connecting piece 38*a*, and the first tilting portion 42*b* and the second tilting portion 46*b* in the unbroken connecting piece 38*b* may not be substantially horizontal but can be inclined in predetermined directions. As will be clearly understood by reference to FIG. 2, the unbroken connecting piece 38*a* and the unbroken connecting piece 38*b* are not in line symmetry with each other, and their components are somewhat different in circumferential dimension (see Patent Document 2 for the reason.)

In the region other than the specific region indicated by the numeral 30 where the protruding piece 34 and a pair of the unbroken connecting pieces 38*a* and 38*b* are present, a plurality of breakable bridge portions 48 to connect the tamper evident bottom portion 6 to the lower end of the skirt wall 10 of the body 4 are arranged with spacing in the circumferential direction. In the illustrated embodiment, six narrow projections extending in an axial direction are formed with spacing in the circumferential direction over the inner surface of the skirt wall 10 and the inner surface of the tamper evident bottom portion 6. Apart of each of the narrow projections that is located between the skirt wall 10 and the tamper evident bottom portion 6 serves as the breakable bridge portion 48 (see FIG. 3.) If desired, the breakable bridge portion can also be disposed in the region where a pair of the unbroken connecting pieces 38*a* and 38*b* are present. For example, the breakable bridge portion can be disposed between the first tilting portions 42*a*, 42*b* and the skirt wall 10, between the second tilting portions 46*a*, 46*b* and the tamper evident bottom portion 6, or between the protruding piece 34 and the tamper evident bottom portion 6.

FIG. 5 shows a mouth-and-neck portion 50 of a container together with the container closure 2. The mouth-and-neck portion 50 of the container, which can be formed from a suitable synthetic resin such as polyethylene terephthalate or from glass, is in a cylindrical shape as a whole, and its upper surface is open. An external thread 52 and an engaging jaw portion 54 located below the external thread 52 are formed on the outer peripheral surface of the mouth-and-neck portion 50.

In mounting the container closure 2 on the mouth-and-neck portion 50 to seal the mouth-and-neck portion 50, the container closure 2 is fitted on the mouth-and-neck portion 50, and rotated in a closing direction (clockwise when viewed from above in FIG. 5) to screw the internal thread 18 of the container closure 2 to the external thread 52 of the mouth-and-neck portion 50. As the screwing of the internal thread 18 to the external thread 52 proceeds, the container closure 2 is gradually lowered down with respect to the mouth-and-neck portion 50. When the container closure 2 has been lowered with respect to the mouth-and-neck portion 50 to a state shown in FIG. 5, the inner annular projection 12 and the outer annular projection 14 formed on the inner surface of the top panel wall 8 in the body 4 of the container closure 2 come into intimate contact with the inner peripheral surface and the outer peripheral surface, respectively, of the mouth-and-neck portion 50, whereby the mouth-and-neck portion 50 is sealed. In each of the engaging pieces 24*a*-24*i* disposed on the inner peripheral surface of the tamper evident bottom portion 6 of the container closure 2, the major part, i.e., the part other than the extending portions 26, is elastically deformed to be located below the engaging jaw portion 54 of the mouth-and-neck portion 50, while the upper surface of the engaging protrusion 28 formed on the inner surface is located to face the lower surface of the engaging jaw portion 54. Meanwhile, the extending portions 26 in each of the engaging pieces 24*a*-24*i* are located between the skirt wall 10 of the body 4 and the engaging jaw portion 54 of the mouth-and-neck portion 50, specifically between the inner peripheral surface of the skirt wall 10 and the outer peripheral surface of the engaging jaw portion 54.

In unsealing the mouth-and-neck portion 50, the container closure 2 is rotated in an opening direction (counterclockwise when viewed from above in FIG. 5) to gradually release the screwing of the internal thread 18 of the container closure 2 to the external thread 52 of the mouth-and-neck portion 50. Upon gradual release of the screwing, the body 4 of the container closure 2 is allowed to ascend as it is rotated in the opening direction. On the other hand, the tamper evident bottom portion 6 is inhibited from ascending, because the upper surface of the engaging protrusion 28 of each of the engaging pieces 24*a*-24*i* is in engagement with the lower surface of the engaging jaw portion 54 of the mouth-and-neck portion 50. Accordingly, the breakable bridge portions 48 are placed under considerable stress and broken. Then, the body 4 of the container closure 2 ascends as it is rotated in the opening direction, and is gradually spaced upward from the tamper evident bottom portion 6. As will be clearly understood by reference to FIG. 6, when the body 4 is gradually spaced upward from the tamper evident bottom portion 6, the first tilting portion 42*a* of the unbroken connecting piece 38*a* and the second tilting portion 46*b* of the unbroken connecting piece 38*b* are pivoted clockwise, that is, tilted clockwise, in FIG. 6 about the intermediate portion 44*a* and the lower end of the second tilting portion 46*b*, respectively, whereas the second tilting piece 46*a* of the unbroken connecting piece 38*a* and the first tilting portion 42*b* of the unbroken connecting piece 38*b* are pivoted counterclockwise, that is, tilted counterclockwise, in FIG. 6 about the lower end and the upper end, respectively. In accordance with these motions, the first tilting portions 42*a* and 42*b* and the second tilting portions 46*a* and 46*b* of the respective unbroken connecting pieces 38*a* and 38*b* have their inclination angle with respect to the vertical line gradually decreased. As will be clearly understood by reference to FIG. 7 along with FIG. 6, when the screwing of the internal thread 18 of the container closure 2 to the external thread 54 of the mouth-and-neck portion 50 has been completely released, the body 4 of the container closure 2 is removed from the mouth-and-neck portion 50. However, the body 4 continues to be connected via the unbroken connecting pieces 38*a* and 38*b* to the tamper evident bottom portion 6 which is continuously mounted on the mouth-and-neck portion 50, and thus it will not be separated from the mouth-and-neck portion 50 of the container.

After the body 4 of the container closure 2 has been removed from the mouth-and-neck portion 50, the body 4 is pivoted, with the intermediate portions 44*a* and 44*b* of the unbroken connecting pieces 38*a* and 38*b* as fulcrums, away from the mouth-and-neck portion 50 (clockwise in FIG. 7). At this time, as shown in FIG. 7, an extending end of the protruding piece 34 contacts one side parts of the engaging pieces 24*a* and 24*i* (a left side part of the engaging piece 24*a* and a right side part of the engaging piece 24*i* in FIG. 4), and the protruding piece 34 is elastically deformed to ascend along the outer surfaces of the engaging pieces 24*a* and 24*i*, and then along the concave arc-shaped sites 26*a* on the outer surfaces of the extending portions 26 of the engaging pieces 24*a* and 24*i* (the left side extending portion 26 of the engaging piece 24*a* and the right side extending portion 26 of the engaging piece 24*i* in FIG. 4). Later, a lower part of the protruding piece 34 elastically passes over the concave arc-shaped sites 26*a* of the extending portions 26 until the raised portion 35 of the protruding piece 34 comes into contact with the outer surfaces of the extending portions 26 as illustrated in FIGS. 8 and 9. In this manner, the body 4 of the container closure 2 is held at an opening position shown in FIGS. 8 and 9. When the protruding piece 34 passes over the arc-shaped sites 26*a* of the extending portions 26 and is elastically restored, a sound is produced.

According to the container closure 2 of the present invention, the raised portion 35 formed on the outer surface of the protruding piece 34 serves to hold the body 4 at a required opening position by coming into contact with the outer surfaces of the extending portions 26. Thus, even if the container closure is relatively short in the axial direction, it is possible to ensure a large pivot angle of the body 4, when located at a required opening position, with respect to the mouth-and-neck portion 50 of the container. Further, since the raised portion 35 sufficiently reliably comes into contact with the outer surfaces of the extending portions 26, the body 4 is sufficiently reliably kept at a required opening position.

When eating or drinking of the contents is interrupted, the body 4 held at the position shown in FIG. 8 is forcibly pivoted toward the mouth-and-neck portion 50 (counterclockwise in FIG. 8) and fitted on the mouth-and-neck portion 50 again. Then, the container closure 2 is rotated in the closing direction to screw the internal thread 18 of the container closure 2 to the external thread 52 of the mouth-and-neck portion 50. In this manner, the container closure 2 is located at the position shown in FIG. 5 again, whereby the mouth-and-neck portion 50 can be temporarily sealed.

FIG. 10 shows another preferred embodiment of the container closure constituted in accordance with the present invention. According to this embodiment, an interlocking means is disposed on the raised portion 35 of the protruding piece 34, and an interlock means is disposed on the outer surface of each of the extending portions 26 of the engaging pieces 24*a*-24*i*. More specifically, three projections 37*a*, 37*b* and 37*c* extending in the circumferential direction are formed to be spaced in a vertical direction over an entire width of the surface of the raised portion 35. These projections 37*a*, 37*b* and 37*c* serve as the interlocking means. Meanwhile, on the outer peripheral surface of each of the extending portions 26 of the engaging pieces 24*a*-24*i*, a boundary region 26*c* is provided between the concave arc-shaped site 26*a*, which gradually protrudes radially outwardly in the upward direction, and the site 26*b*, which gradually recedes radially inwardly in the upward direction. The boundary region 26*c* serves as the interlock means. In the embodiment illustrated in FIG. 10, when the lower part of the protruding piece 34 passes over the concave arc-shaped sites 26*a* of the extending portions 26 until the body is pivoted to an opening position, the boundary region 26*c* of each of the extending portions 26 is interlocked between the projection 37*a* and the projection 37*b* (or between the projection 37*b* and the projection 37*c*) of the protruding piece 34. In this manner, the body 4 is reliably held at an opening position shown in FIG. 10.

In the embodiment illustrated in FIG. 10, the interlocking means is disposed on the raised portion 35 of the protruding piece 34. If desired, the raised portion 35 may be omitted, and the interlocking means can be disposed on the outer surface of the protruding piece 34. Further, the interlocking means is composed of the three projections 37*a*, 37*b* and 37*c* formed to be spaced in the vertical direction. However, the interlocking means can be composed of one, two, or four or more projections, or of one or a plurality of grooves extending in the circumferential direction over an entire width of each of the extending portions 26. Other components in the embodiment illustrated in FIG. 10 than those described above may be substantially the same as those in the embodiment illustrated in FIGS. 1 to 9.

The detailed description above refers to preferred embodiments of the container closure constituted in accordance with the present invention with reference to the attached drawings. The present invention is not limited to these embodiments, but various variations and modifications may be made without departing from the scope of the present invention. For example, the extending portion 26 is formed in both side parts in the circumferential direction of each of the engaging pieces 24*a*-24*i* in the illustrated embodiments. However, it is also possible to form one or three or more extending portions at any suitable site(s) (e.g., in a central part or at plural sites spaced in the circumferential direction) of each of the engaging pieces 24*a*-24*i*. If desired, it is also possible to form one extending portion having substantially the same width as the circumferential width of each of the engaging pieces 24*a*-24*i*. Further, the extending portions 26 are formed at the respective engaging pieces 24*a*-24*i* in the illustrated embodiments. If desired, the extending portions cart be formed only at a plurality of specific engaging pieces or at engaging pieces disposed in an angle region where the protruding piece 34 is present. In the illustrated embodiments, the two engaging pieces 24*a* and 24*i* are present in the angle region where the protruding piece 34 is present. However, it is also possible to provide only one engaging piece in the angle region where the protruding piece 34 is present and to form the extending portion only at this engaging piece. In the case of an annular engaging piece that extends continuously in the circumferential direction, it is possible to form: one or a plurality of extending portions in the angle region where the protruding piece 34 is present; a plurality of extending portions spaced in the circumferential direction not only in the angle region where the protruding piece 34 is present but also throughout the remaining angle region; or an annular extending portion that extends continuously in the circumferential direction. Further, the protruding piece 34 in the illustrated embodiments is composed of a single piece. However, the protruding piece can be composed of a plurality of pieces, or a single piece that is divided into a plurality of parts by one or a plurality of slits formed to extend from a protruding end (lower end) toward a base end (upper end) of the single piece. In the illustrated embodiments, the two unbroken connecting pieces 38*a* and 38*b* are disposed on both sides in the circumferential direction of the protruding piece 34. However, it is also possible to dispose one or three or more unbroken connecting pieces.

EXPLANATIONS OF LETTERS OR NUMERALS

2: Container closure
4: Body
6: Tamper evident bottom portion
8: Top panel wall
10: Skirt wall
18: internal thread
22: Engaging means
24*a*-24*i*: Engaging pieces
26: Extending portion
34: Protruding piece
35: Raised portion
37*a*-37*b*: Projections (engaging means)
38*a*: Unbroken connecting piece
38*b*: Unbroken connecting piece
48: Breakable bridge portion
50: Mouth-and-neck portion
52: External thread
54: Engaging jaw portion

The invention claimed is:

1. A synthetic resin container closure to be applied to a container in which an external thread and an engaging jaw portion boated below the external thread are formed on an outer peripheral surface of a mouth-and-neck portion, the synthetic resin container closure comprising:

a body which has a top panel wall, and a cylindrical skirt wall extending downwardly from a peripheral edge of the top pan& wall, and in which an internal thread to be screwed to the external thread is formed on an inner peripheral surface of the skirt wall; and a cylindrical tamper evident bottom portion which is connected to the skirt wall of the body via a plurality of breakable bridge portions arranged with spacing in a circumferential direction, and in which an engaging means to be engaged with the engaging jaw portion is disposed on an inner peripheral surface of the tamper evident bottom portion, the engaging means being composed of a plurality of engaging pieces disposed with spacing in the circumferential direction and extending upward and radially inwardly from a base end connected to the tamper evident bottom portion, or an annular engaging piece extending continuously in the circumferential direction and extending upward and radially inwardly from the base end connected to the tamper evident bottom portion, a protruding piece protruding downward being disposed on the skirt wall of the body, and an unbroken connecting piece being disposed to connect the skirt wall of the body and the tamper evident bottom portion and to allow the body to be moved upward with respect to the tamper evident bottom portion, wherein an extending portion is formed at the engaging piece at least in an angle region where the protruding piece is present, the extending portion configured for being located between the engaging jaw portion of the mouth-and-neck portion and the tamper evident bottom portion in a state where the synthetic resin container closure is mounted on the mouth-and-neck portion, a raised portion is formed on an outer surface of the protruding piece, and when the body is rotated in an opening direction to unseal the mouth-and-neck portion sealed with the synthetic resin container closure mounted thereon, the breakable bridge portions are broken, so that the body is moved upward from the tamper evident bottom portion, and when the body is pivoted about a predetermined site of the unbroken connecting piece by more than a predetermine angle with respect to the tamper evident bottom portion, a lower part of the protruding piece elastically passes over the extending portion until the raised portion of the protruding piece comes into contact with an outer surface of the extending portion.

2. The synthetic resin container closure according to claim 1, wherein an engaging protrusion is formed on an inner surface of the engaging piece, the engaging protrusion protruding radially inwardly below the engaging jaw portion in a state where the synthetic resin container closure is mounted on the mouth-and-neck portion.

3. The synthetic resin container closure according to claim 1, wherein the extending portion is also formed in a region other than the angle region where the protruding piece is present.

4. The synthetic resin container closure according to claim 1, wherein the engaging means is composed of a plurality of the engaging pieces disposed with spacing in the circumferential direction and extending upward and radially inwardly from the base end connected to the tamper evident bottom portion, and the extending portion is formed in both side parts in the circumferential direction of each of the engaging pieces.

5. The synthetic resin container closure according to claim 1, wherein the outer surface of the extending portion gradually protrudes radially outwardly in an upward direction and then gradually recedes radially inwardly in the upward direction.

6. The synthetic resin container closure according to claim 5, wherein a site on the outer surface of the extending portion that gradually protrudes radially outwardly in the upward direction is concave arc-shaped in longitudinal cross section.

7. The synthetic resin container closure according to claim 1, wherein arc-shaped projections extending continuously in the circumferential direction are formed in a lower end part of an outer peripheral surface of the skirt wall and an upper end part of an outer peripheral surface of the tamper evident bottom portion, respectively, except for a specific region, and an amount of radial protrusions of the raised portion corresponds to amounts of radial protrusion of the projections.

8. The synthetic resin container closure according to claim 1, wherein an interlock means is formed on the outer surface of the extending portion, and an interlocking means to be interlocked with the interlock means is formed on the raised portion of the protruding piece.

9. The synthetic resin container closure according to claim 8, wherein the outer surface of the extending portion gradually protrudes radially outwardly in an upward direction and then gradually recedes radially inwardly in the upward direction, a boundary region between a site that gradually protrudes radially outwardly in the upward direction and a site that gradually recedes radially inwardly in the upward direction serves as the interlock means, and at least one projection or groove extending in the circumferential direction is formed on the raised portion of the protruding piece to serve as the interlocking means.

10. A synthetic resin container closure to be applied to a container in which an external thread and an engaging jaw portion located below the external thread are formed on an outer peripheral surface of a mouth-and-neck portion, the synthetic resin container closure comprising:

a body which has a top panel wall, and a cylindrical skirt wall extending downwardly from a peripheral edge of the top panel wall, and in which an internal thread to be screwed to the external thread is formed on an inner peripheral surface of the skirt wall; and a cylindrical tamper evident bottom portion which is connected to the skirt wall of the body via a plurality of breakable bridge portions arranged with spacing in a circumferential direction, and in which an engaging means to be engaged with the engaging jaw portion is disposed on an inner peripheral surface of the tamper evident bottom portion, the engaging means being composed of a plurality of engaging pieces disposed with spacing in the circumferential direction and extending upward and radially inwardly from a base end connected to the tamper evident bottom portion, or an annular engaging piece extending continuously in the circumferential direction and extending upward and radially inwardly from the base end connected to the tamper evident bottom portion, a protruding piece protruding downward being disposed on the skirt wall of the body, and an unbroken connecting piece being disposed to connect the skirt wall of the body and the tamper evident bottom portion and to allow the body to be moved upward with respect to the tamper evident bottom portion, wherein an extending portion is formed at the engaging piece at least in an angle region where the protruding piece is present, the extending portion being located between the engaging jaw portion of the mouth-and-neck portion and the tamper evident bottom portion in a state where the synthetic resin container closure is mounted on the mouth-and-neck portion, and an interlock means is formed on an outer surface of the extending portion, an interlocking means to be interlocked with the interlock means is formed on an outer surface of the protruding piece, and when the body is rotated in an opening direction to unseal the mouth-and-neck portion sealed with the synthetic resin container closure mounted thereon, the breakable bridge portions are broken, so that the body is moved upward from the tamper evident bottom portion, and when the body is pivoted about a predetermined site of the unbroken connecting piece by more than a predetermine angle with respect to the tamper evident bottom portion, a lower part of the protruding piece elastically passes over the extending portion until the interlocking means of the protruding piece is interlocked with the interlock means of the extending portion.

11. The synthetic resin container closure according to claim 10, wherein the outer surface of the extending portion gradually protrudes radially outwardly in an upward direction and then gradually recedes radially inwardly in the upward direction, a boundary region between a site that gradually protrudes radially outwardly in the upward direction and a site that gradually recedes radially inwardly in the upward direction serves as the interlock means, and at least one projection or groove extending in the circumferential direction is formed on the outer peripheral surface of the protruding piece to serve as the interlocking means.

12. The synthetic resin container closure according to claim 10, wherein an enaaging protrusion is formed on an inner surface of the engaging piece, the engaging protrusion being configured for protruding radially inwardly below the engaging jaw portion in a state where the synthetic resin container closure is mounted on the mouth-and-neck portion.

13. The synthetic resin container closure according to claim 10, wherein the extending portion is also formed in a region other than the angle region where the protruding piece is present.

14. The synthetic resin container closure according to claim 10, wherein the engaging means is composed of a plurality of the engaging pieces disposed with spacing in the circumferential direction and extending upward and radially inwardly from the base end connected to the tamper evident bottom portion, and the extending portion is formed in both side parts in the circumferential direction of each of the engaging pieces.

15. The synthetic resin container closure according to claim 10, wherein the outer surface of the extending portion gradually protrudes radially outwardly in an upward direction and then gradually recedes radially inwardly in the upward direction.

16. The synthetic resin container closure according to claim 15, wherein a site on the outer surface of the extending portion that gradually protrudes radially outwardly in the upward direction is concave arc-shaped in longitudinal cross section.

* * * * *